US007138899B2

(12) United States Patent
Jöllenbeck et al.

(10) Patent No.: US 7,138,899 B2
(45) Date of Patent: Nov. 21, 2006

(54) FUSE ELEMENT WITH A TEMPORARY QUASI-HERMETIC SEAL OF ITS INTERIOR

(75) Inventors: André Jöllenbeck, Bochum (DE); Uwe Röder, Witten (DE); Andreas Baus, Dortmund (DE); Frank Althoff, Hamm (DE); Werner Barz, Herdecke (DE); Peter Pössnicker, Witten (DE)

(73) Assignee: Wickmann-Werke GmbH, Witten (DE)

( * ) Notice: Subject to any disclaimer, the term of this patent is extended or adjusted under 35 U.S.C. 154(b) by 319 days.

(21) Appl. No.: 10/788,215

(22) Filed: Feb. 26, 2004

(65) Prior Publication Data

US 2004/0183646 A1 Sep. 23, 2004

(30) Foreign Application Priority Data

Mar. 4, 2003 (EP) ..... 03004735

(51) Int. Cl.
*H01H 85/42* (2006.01)
*H01H 85/38* (2006.01)

(52) U.S. Cl. ..... 337/281; 337/273; 337/250

(58) Field of Classification Search ..... 337/228, 337/248, 232, 186, 249, 250, 273, 281
See application file for complete search history.

(56) References Cited

U.S. PATENT DOCUMENTS 1,700,080 A 1/1929 Sandin
2,135,166 A 11/1938 Bussman
2,166,174 A 7/1939 Popp
4,158,187 A 6/1979 Perreault
4,656,453 A 4/1987 Reeder
5,198,792 A * 3/1993 Bacon et al. ..... 337/251
5,235,307 A * 8/1993 Oh ..... 337/228

OTHER PUBLICATIONS

Mechanical Behavior, Properties and Behavior of plastics, Canadian Building Digest, 1973, pp. 2-7, downloaded from http://irc.nrc-cnrc.gc.ca/pubs/cbd/cbd157_e.html.*
Plastic materials having a yield strength above 10MPa obtained from a search at www.matweb.com.*

* cited by examiner

*Primary Examiner*—Anatoly Vortman
(74) *Attorney, Agent, or Firm*—Bell, Boyd & Lloyd LLC

(57) ABSTRACT

A fuse element includes a fusible conductor which extends within a gas filled cavity in a cylindrical tube. The fuse element includes a cylindrical tube comprising, an electrical insulator between two end faces of the tube, two end caps of an electrically conductive material being applied to the two ends of the tube such that an electrical contact is produced with the fusible conductor. At least one respective sealing element is inserted in at least one of the two ends in a space between the cap base and the end face of the tube and/or into a portion of the cavity of the tube adjacent to the end face such that one or more pressure balancing passages remain between the gas filled cavity within the tube and the external surroundings of the fuse element. The one or more pressure balancing passages are of such small cross-section that changes in pressure in the cavity are balanced only very slowly. A sudden increase in pressure in the cavity, such as occurs as a result of an arc, which is produced when the fusible conductor ruptures, can act to quench the arc.

15 Claims, 2 Drawing Sheets

FUSE ELEMENT WITH A TEMPORARY QUASI-HERMETIC SEAL OF ITS INTERIOR

1. FIELD OF THE INVENTION

The invention relates to a fuse element with a fusible conductor, which extends in a cavity within a cylindrical tube comprising an electrical insulator between two end faces of the tube, two end caps of an electrically conductive material being applied to the two ends of the tube so than an electrical contact is produced with the fusible conductor.

2. DESCRIPTION OF THE PRIOR ART

Fuse elements of the type referred to above have been known for a long time. There are, for instance, fuse elements, in which the cylindrical tube consists of a ceramic material and has a circular cylindrical cavity and a rectangular outer shape with rounded edges. The fusible conductor is, for instance, a wire which extends diagonally within the cavity such that it contacts the walls of the tube only at the ends. The wire of the fusible conductor is passed at both ends around the end faces of the tube, whereby the ends of the fusible conductor wire engage the outer walls of the tube. Metallic end caps are placed on the two ends of the tube. The end caps can, for instance, be of elastic material and pressed onto the ends of the tube, whereby the pressing process ensures not only a firm fit of the end caps but also electrical contact with the fusible conductor. The metal caps can also be secured to the ends of the tube by adhesive or be welded to the outer wall of the tube after it has been appropriately prepared. A series of techniques for applying the end caps are known which ensure not only a firm fit of the caps but also good electrical contact with the fusible conductor.

There are fuse elements of the type referred to above, in which a gap remains between the end caps and the wall of the tube such that the interior of the tube is connected to the surroundings of the tube via the gap. In this event, there is a gas exchange between the internal space and the surroundings. In the event of warming and expansion of the gas in the internal space, it flows out of the internal space so that a relatively rapid pressure balance occurs.

There are also fuse elements, in which the caps are applied to the ends of the tubes such that the internal space is hermetically sealed. The internal space of these elements can be filled with air, with a special gas mixture (for instance nitrogen) under normal pressure or reduced pressure or can also contain a vacuum.

If the fusible conductor in the interior of the tube is ruptured (blows; i.e. the fuse breaks the contact), an arc generally forms. The pulse of supplied energy as a result of the arc heats the gas which may be present in the cavity and the materials vaporised by the fusion. In the case of a fuse element with a hermetically sealed cavity and an air or gas filling, the energy supplied by the arc results in a sudden, violent increase of the gas pressure in the interior of the fuse element. This pressure has a quenching effect on the arc and is thus desirable. Disadvantageous, however, with a fuse element with a hermetically sealed interior is that the pressure increase in the interior is also produced if the fuse element is heated from the exterior, for instance during an installation process. Such heating occurs, for instance, when soldering an SMD fuse element. The pressure increase in the interior of the tube associated with such heating results in undesired stressing of the fuse element and can result in damage of the element under extreme installation conditions.

It is the object of the invention to provide a fuse element which combines the advantage of the sudden pressure increase in the event of rupturing of the fusible conductor with a high reliability of the element in the event of heating during installation of the element.

3. SUMMARY OF THE INVENTION

This object is solved by a fuse element with the features of claim 1. Starting from a fuse element of the type referred to above, at least one respective elastic sealing element is inserted at both ends of the tube into a space between the respective cap base and the end face of the tube and/or into a portion of the cavity of the tube adjacent to the end face such that one or more pressure balancing passages remain between the gas filled cavity of the tube and the external surroundings of the fuse element of such small cross-sectional area that changes in pressure in the cavity are balanced only very slowly so that a sudden rise in pressure in the cavity, as occurs as a result of an arc, can act to quench the arc. In the event of sudden increases in pressure within a short period of time, the fuse element behaves transiently (temporarily) as though the cavity were hermetically sealed. This is referred to in the context of this description as a temporary quasi-hermetic seal of the cavity. The effective cross-sectional area and the length of the pressure balancing passage(s) between the cavity and the external surroundings should be dimensioned in dependence on the volume of the cavity and the temperature gradients occurring during installation so that a predetermined maximum pressure increase in the cavity is not exceeded during installation. This results in minimum cross-sectional areas and maximum lengths of the pressure balancing passages. On the other hand, the pressure balancing passages should be small enough so that the desired sudden pressure increase in the event of cutting out decays so slowly that it can firstly act on the arc to quench it.

The system comprising the gas filled cavity and the pressure balancing passages, through which gas flows, when subjected to a sudden pressure change, exhibits balancing processes in the cavity which, in an electrical analogy, may be modelled approximately in the form of low-pass behaviour. A time constant is produced for an approximation of a low pass of the first order, which may be derived from the exponentially decaying pressure in the cavity. The fuse element should preferably be so dimensioned that the time constant of the decay of sudden changes in the differential pressure between the cavity and the external surroundings is of the order of between $10^{-2}$ and $10^{2}$. With such preferred dimensions, the temperature gradients, which occur in SMD installation processes, of, for instance, 2 Kelvin per second only produce acceptably low pressure increases in the cavity.

In one embodiment of the invention, in which the fusible conductor includes a wire, which passes out of the cavity in the tube round the end faces so that the two ends of the wire are disposed between the outer wall of the tube and the respective inner walls of the end caps, the sealing elements in each end cap include a respective plate-shaped sealing element, inserted into the cap base, with a shape matched to the external cross-section of the tube. These sealing elements are pressed by the caps against the end face of the tube, whereby the fusible conductive wire passes between the pressed plate and the end face so that, as a result of the elastic deformation of the inserted plate-shaped sealing element, a very small pressure balancing passage remains between the end face of the tube, the fusible conductive wire and the sealing element. The harder the sealing element is pressed, the smaller is the cross-section of the pressure balancing passages remaining on both sides of the wire.

In a preferred embodiment of the fuse element in accordance with the invention, in which the fusible conductor also includes a wire, which passes out of the cavity of the tube around the end faces so that the two ends of the wire are disposed between the outer wall of the tube and the respective internal walls of the end caps, the sealing elements include at least one respective plug-like sealing element of an elastic material pressed into the cavity in the tube at both ends. The plug of elastic material introduced into the cavity forces a short section of the fusible conductor wire against the internal walls of the tube such that two pressure balancing passages with very small cross-sectional area remain between the internal wall of the tube, the wire and the elastic, deformed sealing element. The cross-sectional area of the pressure balancing passages depends on the cross-section of the wire and on the elastic deformation of the sealing element.

In a preferred embodiment, a respective elastic plastic plug is pushed into the cavity at both ends of the tube. The plastic plugs have a cross-sectional area, in the mechanically unloaded state (before being pressed in) which is the same as or slightly greater than the internal cross-sectional area of the tube. The inserted plastic plug presses the fusible conductor closely against the internal wall of the tube and engages around the fusible conductor pressed against the internal wall such that only a very small pressure balancing passage remains between the fusible conductor, the internal wall of the tube and the plastic plug. The elastic plastic plug consists of, for instance, of a silicone rubber.

Further advantageous and preferred embodiments of the invention are characterised in the dependent claims. The invention will be described below in more detail with reference to preferred embodiments.

4. BRIEF DESCRIPTION OF THE DRAWINGS

5. DESCRIPTION OF THE PREFERRED EMBODIMENTS

Figure 1A:
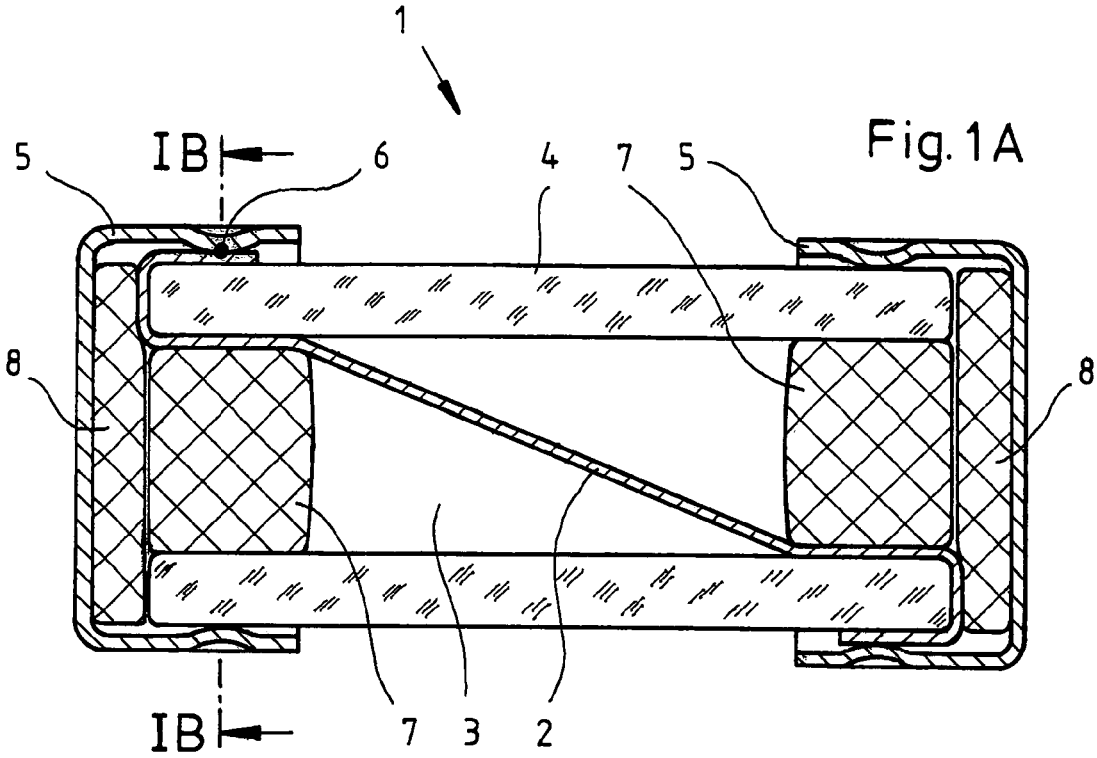
FIG. 1A is a schematic longitudinal sectional view of a fuse element in accordance with the invention.
Figure 1B:
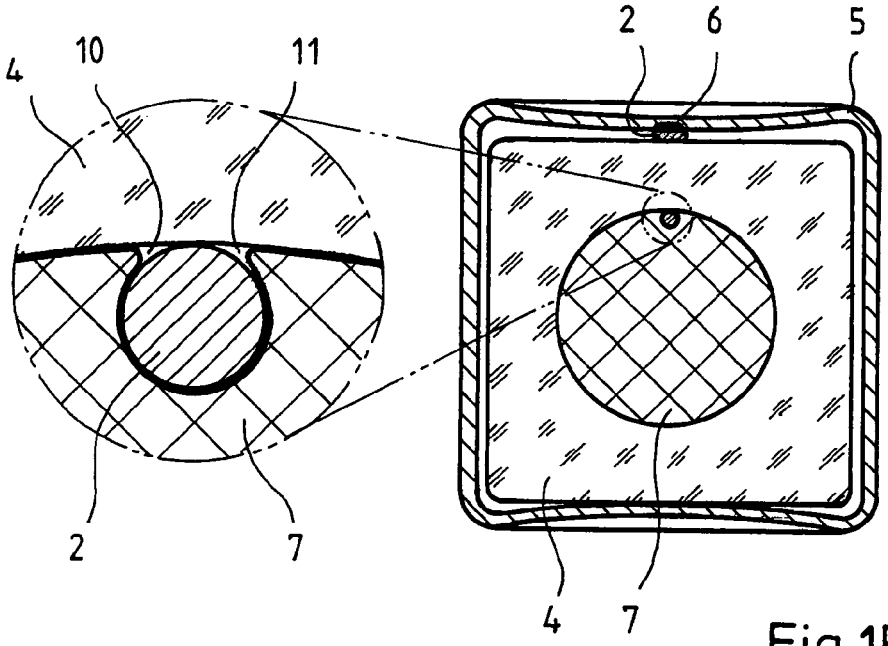
FIG. 1B is a schematic transverse sectional view of the fuse element of FIG. 1A.

The preferred embodiment of the fuse element in accordance with the invention is illustrated in FIGS. 1A and 1B. The fuse element 1 has a fusible conductor 2, which is arranged in the internal cavity 3 of a cylindrical tube 4 such that it transverses the cavity 3 approximately diagonally. The diagonal arrangement of the fusible conductor 2 in the cavity 3 creates defined environmental conditions at the surface of the fusible conductor since it does not contact the internal walls of the tube 4. The fusible conductor 2 is, for instance, a wire with a circular cross-section. In alternative embodiments, the fusible conductor can also have a wire wound spirally around an electrically insulating core. The fusible conductor 2 can also consist of a plurality of wire sections conducted together. At the ends of the tube 4, the fusible conductor is passed around the end faces such that the ends of the fusible conductor 2 rest against the outer wall of the tube 4.

Applied to the ends of the tube 4 are end caps of an electrically conductive material, preferably metal caps. The end caps are manufactured, for instance, from brass plate and subsequently tinned. The tube 4 can be manufactured, for instance, from a ceramic material (e.g. $AL_2O_3$), a glass material or some other electrical insulator. In the preferred embodiment, a plastic tube is used, for instance a tube of a polyamides-copolymer, which is optionally reinforced with glass fibres. The tube 4 is cylindrical and, in the preferred embodiment, has a circular cylindrical inner wall and a rectangular outer cross-section with rounded edges, as is shown in FIG. 1B. In this embodiment, the fusible conductor wire 2 is passed around the end faces of the tube 4 such it engages one of the four outer surfaces of the tube 4 approximately in its centre in the axial direction. The end caps 5 have an internal cross-section which is slightly larger than the external cross-section of the tube 4. They are pushed onto the ends of the tube 4 with the fusible conductor passed over them and deformed from the exterior by indenting them so that they are located mechanically rigidly on the tube 4 and thus clamp the fusible conductor 2 in position. In order to produce a reliable electrical connection between the fusible conductor 2 and end caps 5, a laser pulse soldering is preferably provided at a position 6 between the fusible conductor 2 and the wall of the end cap 5. In a preferred embodiment, the tube 4 has an internal diameter of about 2.5 mm and external dimensions of about 4 mm×4 mm×9.6 mm. The end caps are about 2.8 mm long and have an external diameter of about 4.4 mm.

In accordance with the invention, a respective elastically deformable plastic plug 7 is forced into the cavity 3 at both ends of the tube 4. The external diameter of the elastic plastic plug corresponds to the internal diameter of the tube 4 or is slightly larger. In the preferred embodiment, the plastic plug has a diameter of 2.5 mm and a length of 2 mm. The plastic plug 7 presses the fusible conductor 2 over the length of the plastic plug against the inner wall of the tube 4. The plastic plug 7 is manufactured from a relatively easily deformable elastic material, for instance from a silicone rubber. As is shown in the enlarged scrap view in FIG. 1B, the material of the plastic plug 7 deforms in the vicinity of the fusible conductor 2 such that it engages around the fusible conductor, whereby small pressure balancing passages 10 and 11 remain along the fusible conductor 2 on both sides of the engagement surface of the fusible conductor 2 with the internal wall of the tube 4. The plastic plug 7 may not be fabricated from a materials which, deforms plastically and flows such that it completely surrounds the fusible conductor 2 and leaves no pressure balancing passages. Furthermore, in the preferred exemplary embodiment of the fuse element 1, a small plastic plate 8 is inserted in both end caps 5 between the base of the end cap 5 and the end faces of the tube 4. These plastic plates are compressed and thus deformed so that they partially engage around the fusible conductor 2, which engages the end face of the tube 4. Furthermore, the plastic plates 8 support the plastic plugs 7. The plastic plates 8 and the plastic plugs 7 can be manufactured, for instance, from the same material.

Figure 2:
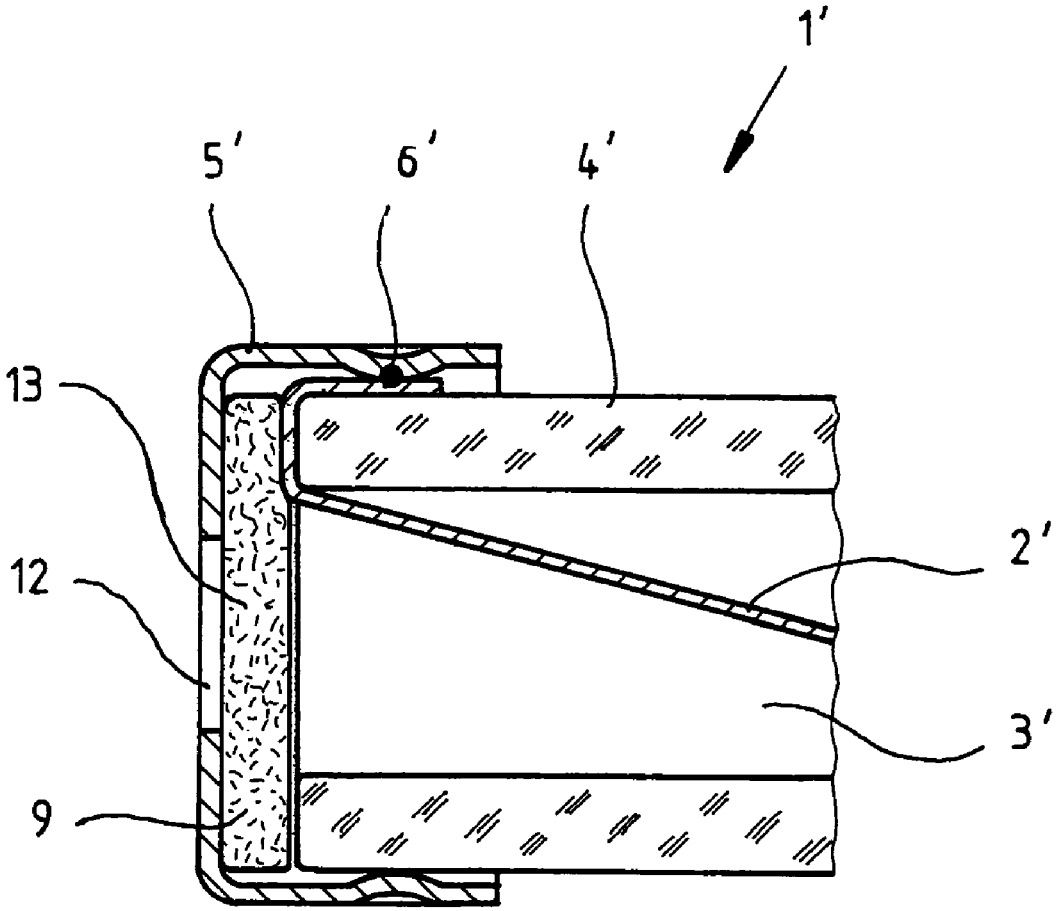
FIG. 2 shows an alternative embodiment of the fuse element in accordance with the invention.

FIG. 2 is a cross-sectional view of a portion of an alternative embodiment of the fuse element 1' in accordance with the invention. The fusible conductor 2' again passes diagonally through the cavity 3' within a tube 4', the ends of the fusible conductor 2' passing around the end faces of the tube 4' and engaging the outer walls of the tube 4'. End caps 5' are positioned on the ends of the tube 4'. Deformation of the cap ensures a tight fit and mechanical retention of the fusible conductor 2'. A laser pulse solder joint 6' can additionally be provided to produce a better electrical contact.

Inserted between the bases of the end caps 5' and the end surfaces of the tube 4' are plates 9 of a deformable, porous material which are pressed tightly against the bases of the end caps and the end faces. At their ends, the end caps have an opening 12, in which a section of the plate 9 is exposed. As a result of the porous structure of the plate 9, small pressure balancing passages 13 are formed, with a suitable choice of material, within the plate 9 between the opening 12 and the internal space 3'.

Numerous alternative embodiments are possible within the scope of the inventive concept. For instance, the embodiment illustrated in FIG. 1 can be modified by connecting together the separate sealing elements 7 and 8 to form one sealing element. It is also possible that the sealing elements are applied only at one end of the tube 4 and the other end is hermetically sealed. In a further modification of the embodiment illustrated in FIG. 1A, the end caps 5 can be secured (e.g. by adhesive or soldered) in a sealed manner to the outer walls of the tube 4 and provided with an additional bore in the cap base to create the pressure balancing passage, whereby in this case the plate 8 comprises a gas permeable material. Finally, embodiments are also possible in which the end caps are positioned hermetically on the ends of the tube 4 and a pressure balancing passage is created in the wall of the tube 4.

The invention claimed is:

1. A fuse element including a fusible conductor, which extends within a gas filled cavity in a cylindrical tube comprising an electrical insulator between two end faces of the tube, two end caps of an electrically conductive material being applied to the two ends of the tube such that an electrical contact is provided with the fusible conductor, wherein at least one respective elastic sealing element is inserted at at least one of the two ends in a space between a cap base and the end face of the tube and/or into a portion of the cavity of the tube adjacent to the end face such that one or more pressure balancing passages remain between the gas filled cavity within the tube and the external surroundings of the fuse element of such small cross-section that changes in pressure in the cavity are balanced only very slowly so that a sudden increase in pressure in the cavity, as occurs as a result of an arc, which is produced when the fusible conductor ruptures, can act to quench the arc wherein the time constant of the decomposition of sudden changes in the differential pressure between the cavity and the external surroundings is of the order of between $10^{-2}$ to $10^{2}$ seconds.

2. A fuse element as claimed in claim 1, wherein the fusible conductor includes a wire which passes out of the cavity in the tube around the end faces so that the two ends of the wire are disposed between an outer wall of the tube and respective inner walls of the end caps.

3. A fuse element as claimed in claim 2, wherein the sealing elements in each end cap include a respective plate-shaped elastic sealing element inserted into the cap base with a shape matched to the external cross-section of the tube.

4. A fuse element as claimed in claim 1, wherein the sealing elements include at least one respective plug-like sealing element of an elastic material pressed into the cavity of the tube at both ends.

5. A fuse element as claimed in claim 4, wherein a respective elastic plastic plug is pressed into the cavity at both ends of the tube, the plastic plugs having a cross-sectional area in the mechanically unloaded state which is the same as or slightly greater than the internal cross-sectional area of the tube, wherein the inserted plastic plug presses the fusible conductor closely against the internal wall of the tube and engages around the fusible conductor pressed against the internal wall such that only a very narrow pressure balancing passage remains between the fusible conductor, the internal wall of the tube and the plastic plug.

6. A fuse element as claimed in claim 4, wherein the plug-like sealing element, which is pressed into the cavity at both ends of the tube, has an enlarged cross-sectional area on its side directed towards the cap base so that the sealing element at least partially fills a space between the end surface of the tube and the cap base.

7. A fuse element as claimed in claim 1, wherein the cavity in the tube has a circular cross-section.

8. A fuse element as claimed in claim 7, wherein the tube has a rectangular external shape with rounded edges.

9. A fuse element as claimed in claim 1, wherein the tube consists of plastic material.

10. A fuse element as claimed in claim 1, wherein the fusible conductor includes a wire which passes out of the cavity in the tube around the end faces so that the two ends of the wire are disposed between the outer wall tube and the respective inner walls of the end caps.

11. A fuse element as claimed in claim 10, wherein the sealing elements in each cap include a respective plate shaped elastic sealing element inserted into the cap base with a shape matched to the external cross section of the tube.

12. A fuse element as claimed in claim 1, wherein the sealing elements include at least one respective plug-like sealing element of an elastic material pressed into the cavity of the tube at both ends.

13. A fuse element as claimed in claim 12, wherein a respective elastic plastic plug is pressed into the cavity at both ends of the tube, the plastic plug having a cross-sectional area in the mechanically unloaded state which is the same as or slightly greater than the internal cross-sectional area of the tube, whereby the inserted plastic plug presses the fusible conductor closely against the internal wall of the tube and engages around the fusible conductor pressed against the internal wall such that only a very narrow pressure balancing passage remains between the fusible conductor, the internal wall of the tube and the plastic plug.

14. A fuse element as claimed in claim 13, wherein the plug-like sealing element, which is pressed into the cavity at both ends of the tube, has an enlarged cross-sectional area on its side directed towards the cap base so that the sealing element at least partially fills a space between the end surface of the tube and the cap base.

15. A fuse element as claimed in claim 5, wherein the plug-like sealing element, which is pressed into the cavity at both ends of the tube, has an enlarged cross-sectional area on its side directed towards the cap base so that the sealing element at least partially fills a space between the end surface of the tube and the cap base.

* * * * *